US005601238A

United States Patent [19]

Rawlins et al.

[11] Patent Number: 5,601,238

[45] Date of Patent: Feb. 11, 1997

[54] FUEL INJECTION NOZZLE

[75] Inventors: Doug C. Rawlins, Murrieta; Kenneth O. Smith, San Diego, both of Calif.

[73] Assignee: Solar Turbines Incorporated, San Diego, Calif.

[21] Appl. No.: 342,513

[22] Filed: Nov. 21, 1994

[51] Int. Cl.[6] ..... B05B 7/10

[52] U.S. Cl. ..... 239/403; 239/419; 239/424; 239/427.3

[58] Field of Search ..... 239/399, 403, 239/418, 419, 419.3, 419.5, 423, 424.4, 427.3, 427.5, 461, 463; 60/737

[56] References Cited

U.S. PATENT DOCUMENTS

| | | | |
|---|---|---|---|
| 2,931,430 | 4/1960 | Marshall | 239/288.3 |
| 3,684,186 | 8/1972 | Helmrich | 239/423 |
| 4,805,837 | 2/1989 | Brooks et al. | 239/463 |
| 5,044,559 | 9/1991 | Russell et al. | 239/419.5 |
| 5,062,792 | 11/1991 | Maghon | 239/403 |
| 5,069,029 | 12/1991 | Kuroda et al. | 60/737 |
| 5,201,181 | 4/1993 | Ohmori et al. | 60/737 |
| 5,218,824 | 6/1993 | Cederwall et al. | 60/737 |
| 5,251,447 | 10/1993 | Joshi et al. | 239/403 |
| 5,351,477 | 10/1994 | Joshi et al. | 239/403 X |
| 5,460,513 | 10/1995 | Flanagan et al. | 239/399 |
| 5,467,926 | 11/1995 | Idleman et al. | 239/419.3 |

FOREIGN PATENT DOCUMENTS

| | | | |
|---|---|---|---|
| 2198521 | 6/1988 | United Kingdom | 239/406 |

*Primary Examiner*—Andres Kashnikow
*Assistant Examiner*—Lisa Ann Douglas
*Attorney, Agent, or Firm*—Larry G. Cain

[57] ABSTRACT

A premix fuel injection nozzle includes a first mixing chamber having a preestablished cross-sectional area and a second mixing chamber having a preestablished cross-sectional areal being larger than the preestablished cross-sectional area of the first mixing chamber. The first mixing chamber and the second mixing chamber are in communication with each other.

17 Claims, 3 Drawing Sheets

FUEL INJECTION NOZZLE

TECHNICAL FIELD

This invention relates generally to a gas turbine engine and more particularly to a fuel injection nozzle for reducing emissions and compensating for combustion induced pressure oscillation.

BACKGROUND ART

The use of fossil fuel in gas turbine engines results in the combustion products consisting of carbon dioxide, water vapor, oxides of nitrogen, carbon monoxide, unburned hydrocarbons, oxides of sulfur and particulates. Of these above products, carbon dioxide and water vapor are generally not considered objectionable. In most applications, governmental imposed regulations are further restricting the remainder of the species, mentioned above, emitted in the exhaust gases.

The majority of the products of combustion emitted in the exhaust can be controlled by design modifications, cleanup of exhaust gases and/or regulating the quality of fuel used. For example, particulates in the engine exhaust have been controlled either by design modifications to the combustor and fuel injectors or by removing them by traps and filters. Sulfur oxides are normally controlled by the selection of fuels that are low in total sulfur. This leaves nitrogen oxides, carbon monoxide and unburned hydrocarbons as the emissions of primary concern in the exhaust gases emitted from the gas turbine engine.

The principal mechanism for the formation of oxides of nitrogen involves the direct oxidation of atmospheric nitrogen. The rate of formation of oxides of nitrogen by this mechanism depends mostly upon the flame temperature and to some degree upon the concentration of the reactants and, consequently, a small reduction in flame temperature can result in a large reduction in the nitrogen oxides.

Attempts to control NOx emissions by regulating the local flame temperature have adopted the use of water or steam injection. This system increases cost due to the additional equipment, such as pumps, lines and storage reservoir. Furthermore, in areas where a supply of water is not readily available the cost and labor to bring in water basically makes this option undesirable.

In an attempt to reduce NOx emissions without incurring increase in operational cost caused by water or steam injection, gas turbine combustion systems have utilized a premix approach. The premix system and nozzles used therewith are examples of attempts to reduce the emissions of oxides of nitrogen. The systems and nozzles described above although generally efficiently controlling the emissions of oxides of nitrogen emitted from the engine exhaust have failed to compensate for combustion induced pressure oscillation problems resulting from the premix approach.

Disclosure of the Invention

A fuel injection nozzle includes a first mixing chamber having a preestablished cross-sectional area and a second mixing chamber having a preestablished cross-sectional area being larger than that of the first mixing chamber. The first and second mixing chambers are in communication with each other.

BEST MODE FOR CARRYING OUT THE INVENTION

Figure 1:
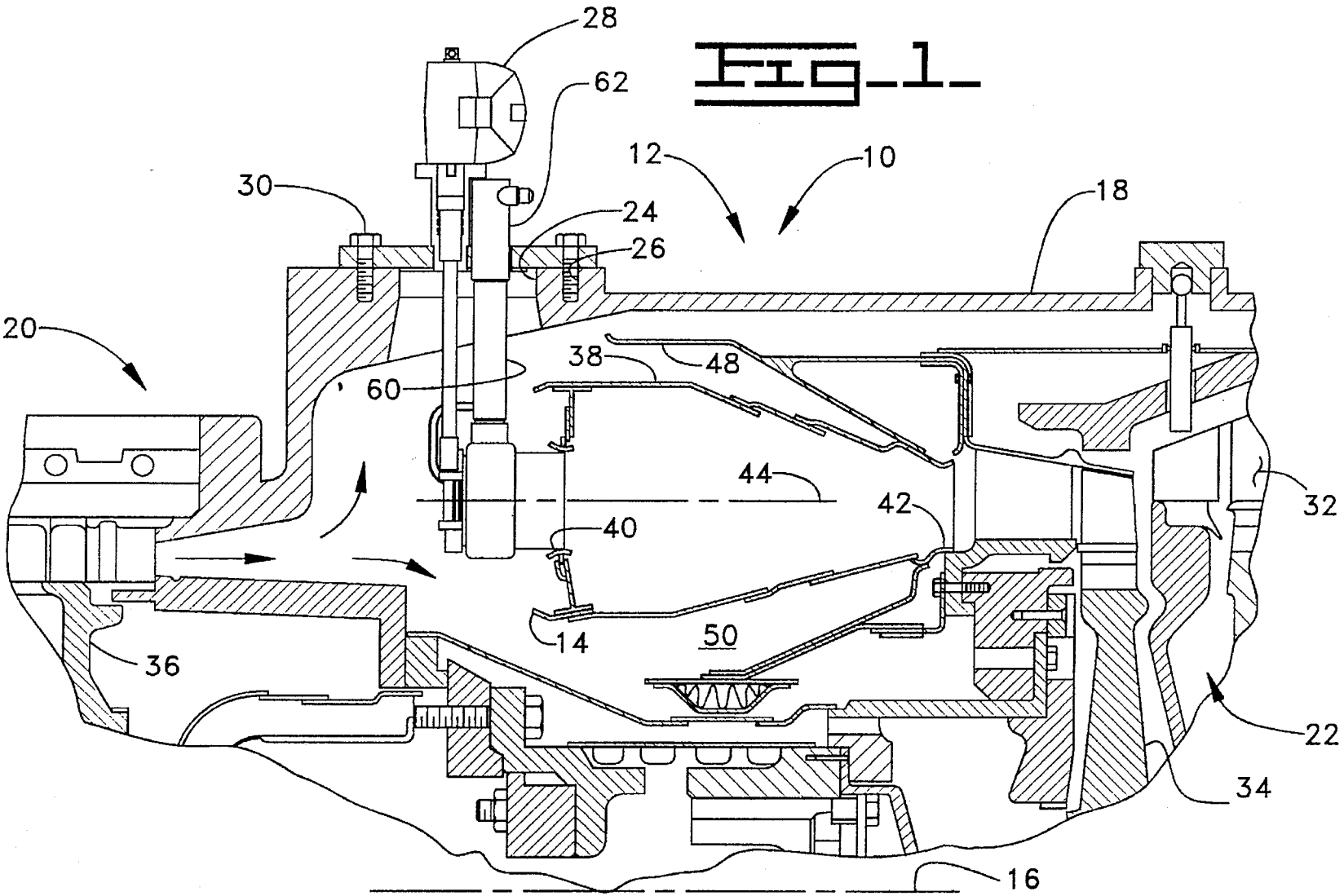
FIG. 1 is a sectional side view of a portion of a gas turbine engine embodying the present invention.

In reference to FIG. 1, a gas turbine engine 10 includes a combustor section 12 having an axial, in line, annular combustor 14 positioned therein. As an alternative to the axial, in line, annular combustor 14, the combustor section 12 could include any type of combustor such as a side mounted combustor or a plurality of can-type combustors without changing the essence of the invention. The gas turbine engine 10 has a central axis 16 and an outer housing 18 coaxially positioned about the central axis 16. The housing 18 is positioned about a compressor section 20 centered about the axis 16 and a turbine section 22 centered about the axis 16. The combustor section 12 is positioned operatively between the compressor section 20 and the turbine section 22. Positioned within the housing 18 intermediate the compressor section 20 and the turbine section 22 is an opening 24 having a plurality of threaded holes 26 positioned therearound. A fuel injection nozzle 28 is conventionally positioned within the opening 24 and attached to the housing 18 by a plurality of bolts 30 engaged in the threaded holes 26. Thus, the fuel injection nozzle 28 is removably attached to the gas turbine engine 10.

The turbine section 22 includes a power turbine 32 having an output shaft, not shown, connected thereto for driving an accessory component such as a generator. Another portion of the turbine section 22 includes a gas producer turbine 34 connected in driving relationship to the compressor section 20. The compressor section 20, in this application, includes an axial staged compressor 36. When the engine 10 is operating, the compressor 36 causes a flow of compressed air to be used for combustion and cooling. As an alternative, the compressor section 20 could include a radial compressor or any source for producing compressed air.

As further shown in FIG. 1, the combustor section 12 includes a multipiece combustor housing 38 having an inlet opening 40 and an outlet opening 42 therein. The combustor housing 38 is supported within the engine 10 in a conventional manner.

Figure 2:
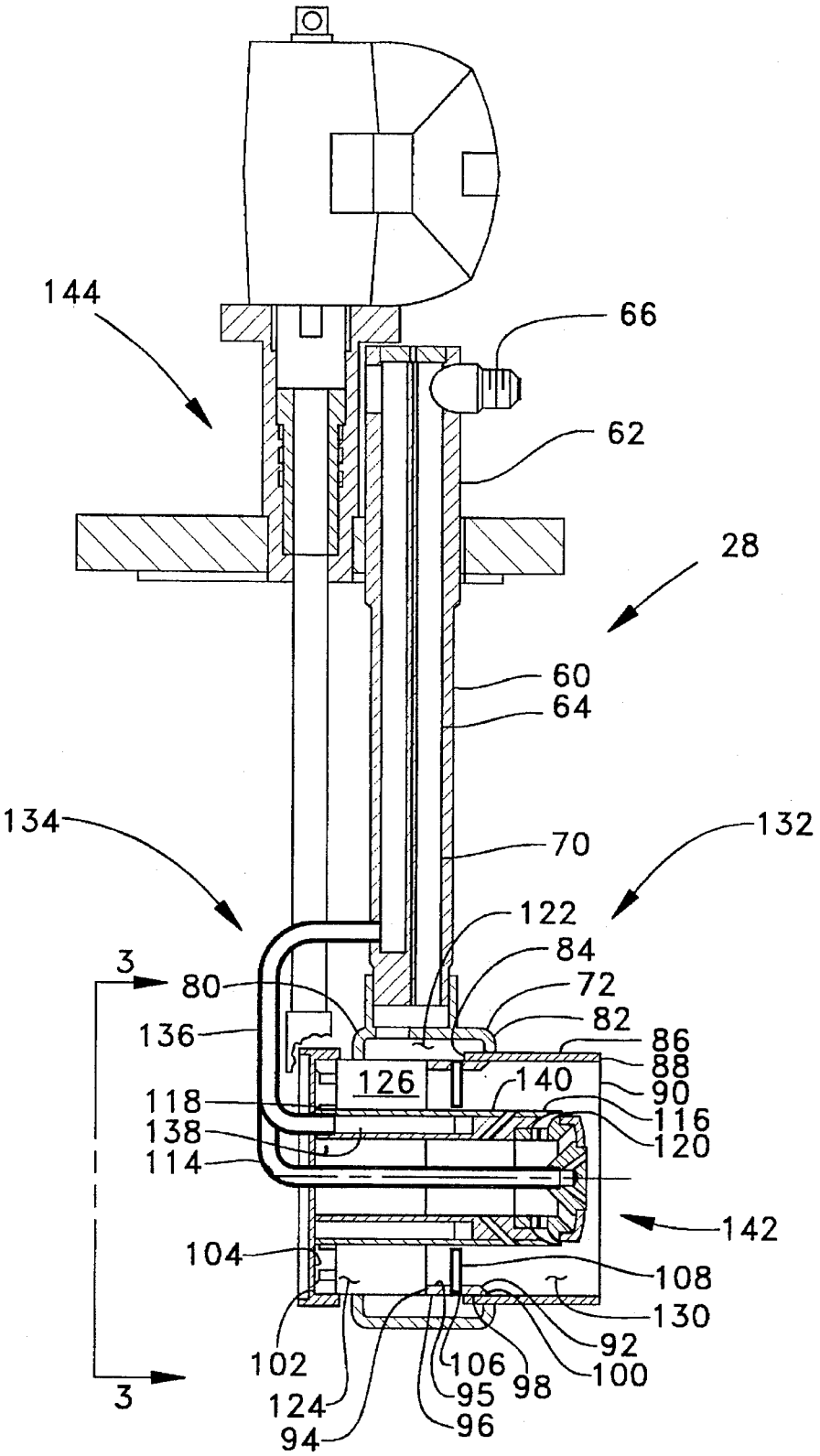
FIG. 2 is an enlarged sectional view of a fuel injection nozzle.
Figure 3:
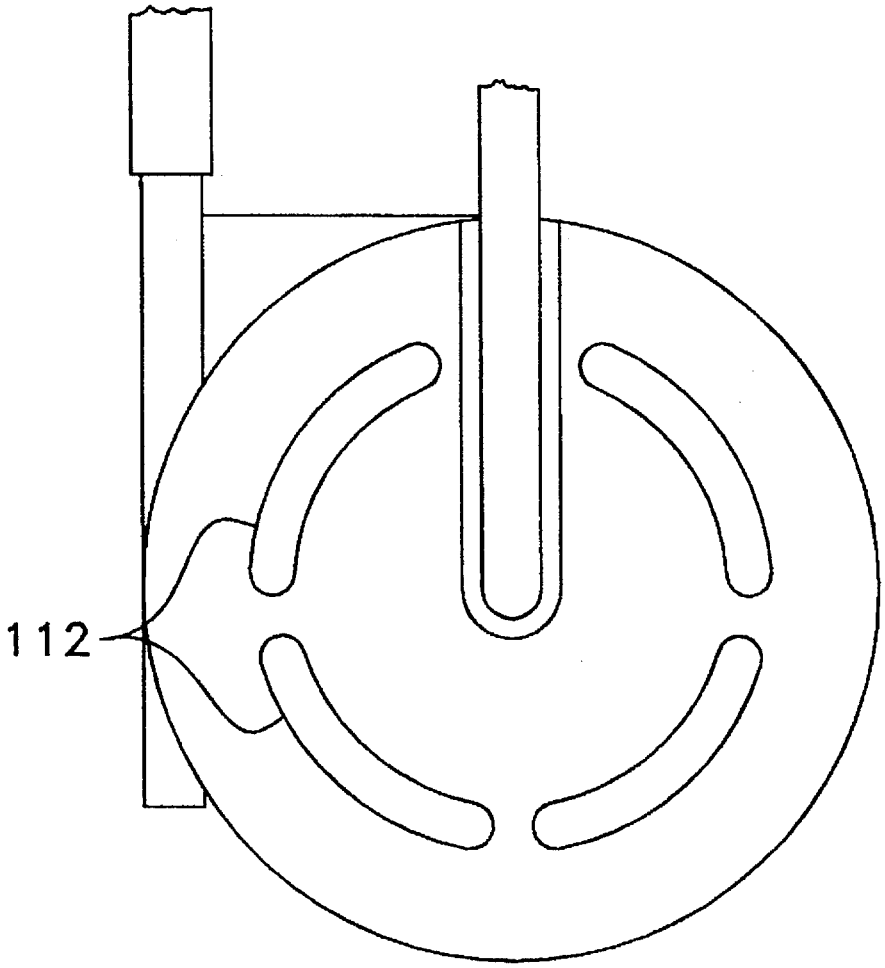
FIG. 3 is a end view taken along line 3—3 of FIG. 2.

As best shown in FIG. 2, the fuel injection nozzle 28 includes a support portion 60 having a cylindrical outer shell 62 positioned in the opening 24 within the housing 18. In this application, positioned within the shell 62 is a gaseous fuel tube 64 which will be in communication with a supply of gaseous fuel at an inlet end 66. An outlet end portion 70 of the gaseous fuel tube 64 is in communication with a first housing 72. The first housing 72 has a generally channel shaped cross-section having a cylindrical configuration. The first housing 72 includes a first flanged end 80 and a second flanged end 82. A first end 84 of a second housing 86 is positioned within the first housing 72 near and in sealing relationship to the second flanged end 82 of the first housing 72. The second housing 86 has a cylindrical configuration having a second end 88 axially extends from the second flanged end 82 of the first housing 72 a preestablished distance and forms an outlet end portion 90 of the fuel injection nozzle 28. A first end 92 of a third housing 94 is positioned in sealing relationship within the second housing 86 near the first end 84 of the second housing 86. The first end 92 has a generally tapered configuration extending radially outward from an inner surface 95 toward an outer surface 98. As an alternative, the first end 92 could be of a generally flat construction. Thus, the combination of the first end 92 positioned in the second housing 86 forms a step or transition member 100. A second end 102 of the third housing 94 extends axially beyond the first flanged end 80 of the first housing 72 and has a cylindrical plate 104 attached thereto. A plurality of radially spaced openings 106 are positioned in the third housing between the first and second ends 92,96 and have a plurality of tubular spoke members 108 positioned in respective ones thereof. As best shown in FIG. 3, the cylindrical plate 104 includes a plurality of slots 112 circumferentially spaced therein. The cylindrical plate 104 is centered on a centerline 114 of the fuel injection nozzle 28. A fourth housing 116 having a general cylindrical configuration is positioned internally of the first, second and third housings 72,86,94. The fourth housing 116 is centered about the centerline 114 and has a first end 118 attached to cylindrical plate 104. A second end 120 of the fourth housing 116 extends axially from the first end 118 and is generally axially positioned within the outlet end portion 90 of the fuel injection nozzle 28.

A fuel gallery 122 is formed within the first housing 72, the first end 84 of the second housing 86 and the third housing 94. The fuel gallery 122 is in communication with the supply of fuel by way of the fuel tube 64. A first mixing chamber 124 is formed between the third housing 94, the cylindrical plate 104 and the fourth housing 116. A plurality of swirlers 126 are positioned within the first mixing chamber 124 near the second end 96 of the third housing 94 and the cylindrical plate 104 and the plurality of tubular spoke members 108 extend into the first mixing chamber 124 interposed the plurality of swirlers 126 and the first end 92 of the third housing 94. The first mixing chamber 124 has a preestablished cross-section area which uniformly extends axially along the entire predetermined length of the first mixing chamber 124. A second mixing chamber 130 is formed between the second housing 86 and the fourth housing 116. The second mixing chamber 130 has a preestablished cross-sectional area which uniformly extends axially along a predetermined length of the second mixing chamber 130. The cross-sectional area of the second mixing chamber 130 is larger than the cross-sectional area of the first fixing chamber 124 and has the transition member 100 interposed the first and second mixing chambers 124,130. Although not required to functionally control the pressure oscilitations, in this application, the predetermined axial length of the first mixing chamber 124 is longer than the predetermined axial length of the second mixing chamber 130. For example, in this application, the predetermined axial length of the first mixing chamber 124 ms about 1.25 times longer than the predetermined axial length of the second mixing chamber 130. Thus, a means 132 for introducing gaseous fuel includes the fuel tube 64, the fuel gallery 122 and the plurality of spoke members 108.

The fuel injection nozzle 28 further includes a means 134 for introducing liquid fuel into the nozzle 28. The means 134 includes a liquid fuel tube 136 being in communication with a source of liquid fuel, not shown. The liquid fuel tube 136 is in communication with a passage 138 exiting into the second mixing chamber 130.

A tubular member 140 is positioned in sealing relationship within the fourth housing 116 and has a pilot means 142 center about the centerline 114 of the fuel injection nozzle 28. The pilot means 142 is of conventional construction. The fuel injection nozzle 28 further includes a means 144 for controlling the flow of combustion air into and through the fuel injection nozzle 28. The means 144 is of conventional construction.

Industrial Applicability

In operation, the gas turbine engine 10 is started in a conventional manner. As the engine 10 increases in speed and load demand from the driven device increases, more fuel and air is introduced to provide more power. For example, the amount or quantity of air from the compressor section 20 entering into the fuel injection nozzles 28 is controlled by the means 144 for controlling which varies the flow through the plurality of radial spaced slots 112. The air passes through the plurality of swirlers 126, is caused to swirl and has fuel mixed therewith as the air passes the plurality of spoke members 108. Thus, air and fuel is premixed within the first mixing chamber 124 and passes axially along the preestablished cross-sectional area of the first mixing chamber 124 at a predetermined velocity. As the premixed air and fuel pass through the transition member 100 and enter the second mixing chamber 130 which has a larger cross-sectional area than the first mixing chamber 124 the predetermined velocity axially along the second mixing chamber 130 is reduced from that for the predetermined velocity in the first mixing chamber 124. Thus, the premixed air and fuel exiting the outlet end portion 90 of the fuel injection nozzle 28 has a lower velocity generally eliminating pressure oscillations while maintaining reduced emissions.

Other aspected, objects and advantages of this invention can be obtained from a study of the drawings, the disclosure and the appended claims.

We claim:

1. A fuel injection nozzle including a pilot means, a first mixing chamber having a preestablished cross-sectional area having an air passing therethrough and in which a means for introducing fuel is positioned therein and said fuel and air are mixed and a second mixing chamber having a preestablished cross-sectional area being larger than that of the first mixing chamber and having said mixture of air and fuel from said first mixing chamber passing therethrough and having additional fuel mixed therewith.

2. The fuel injection nozzle of claim 1 wherein said fuel injection nozzle includes a means for introducing a gaseous fuel into the fuel injection nozzle.

3. The fuel injection nozzle of claim 1 wherein said first mixing chamber is axially positioned upstream of the second mixing chamber.

4. The fuel injection nozzle of claim 1 wherein said first mixing chamber includes a plurality of swirlers positioned therein and said means for introducing fuel being downstream of the plurality of swirlers.

5. The fuel injection nozzle of claim 1 wherein said fuel injection nozzle further includes a transition member intermediate the first mixing chamber and the second mixing chamber.

6. The fuel injection nozzle of claim 5 wherein said transition member includes a generally tapered configuration.

7. The fuel injection nozzle of claim 1 wherein said second mixing chamber has a predetermined axial length and said first mixing chamber has a predetermined axial length which is larger than the predetermined axial length of the second mixing chamber.

8. The fuel injection nozzle of claim 7 wherein said predetermined axial length of said first mixing chamber is about 1.25 times larger than the predetermined axial length of said second mixing chamber.

9. The fuel injection nozzle of claim 1 wherein said fuel injection nozzle includes a means for introducing a liquid fuel into the fuel injection nozzle.

10. The fuel injection nozzle of claim 1 wherein said pilot means is separated from the first and second mixing chambers.

11. The fuel injection nozzle of claim 1 wherein said second mixing chamber has a preestablished cross-sectional area being about 1.2 times that of the cross-sectional area of the first mixing chamber.

12. The fuel injection nozzle of claim 1 where said fuel injection nozzle includes a means for introducing a gaseous fuel and a means for introducing a liquid fuel.

13. The fuel injection nozzle of claim 12 wherein said first mixing chamber has a gaseous fuel introduced therein.

14. The fuel injection nozzle of claim 12 wherein said second mixing chamber has a liquid fuel introduced therein.

15. A fuel injection nozzle including a mixing chamber having a preestablished cross-sectional area being defined within a housing and an another mixing chamber having a preestablished cross-sectional area being defined within an another housing, said another housing being positioned within the housing, said preestablished cross-sectional area of said mixing chamber and said preestablished cross-sectional area of said another mixing chamber having a step therebetween, said step being interposed a radius defined by the preestablished cross-sectional area of the mixing chamber and a larger radius being defined by the preestablished cross-sectional area of the another mixing chamber.

16. The fuel injection nozzle of claim 15 wherein said step includes a generally tapered configuration.

17. The fuel injection nozzle of claim 15 wherein said step includes a generally flat configuration.

* * * * *